United States Patent [19]

Min et al.

[11] 4,112,549

[45] Sep. 12, 1978

[54] APPARATUS FOR DEFLOCCULATING FIBROUS WAD AND UNIFORMLY DISTRIBUTING THE DISINTEGRATED FIBROUS MATERIAL ON A DRY FIBER LAYER FORMING SURFACE

[75] Inventors: Tony C. Min, Houghton, Mich.; Richard E. Hergert, Rockton, Ill.

[73] Assignee: Beloit Corporation, Beloit, Wis.

[21] Appl. No.: 834,788

[22] Filed: Sep. 19, 1977

[51] Int. Cl.[2] ..... D04H 1/00

[52] U.S. Cl. ..... 19/304; 425/83.1

[58] Field of Search ..... 19/155, 156, 156.3, 19/156.4, 200, 304; 264/22–24, 90, 91, 109, 121; 156/73.1, 580.1; 209/1, 2, 3, 111.9; 259/DIG. 44; 425/80–83, 83.1

[56] References Cited

U.S. PATENT DOCUMENTS

| | | | |
|---|---|---|---|
| 2,152,901 | 4/1939 | Manning | 19/156.4 X |
| 2,743,758 | 5/1956 | Uschmann | 19/156 X |
| 2,940,134 | 6/1960 | Heritage | 19/156.3 X |
| 3,344,479 | 10/1967 | Bryan, Jr. | 19/200 X |
| 3,611,508 | 10/1971 | Reinhall et al. | 19/156.3 |
| 3,843,756 | 10/1974 | Talbott et al. | 264/24 |
| 4,014,635 | 3/1977 | Kroyer | 19/156.3 X |

*Primary Examiner*—Dorsey Newton

*Attorney, Agent, or Firm*—Hill, Gross, Simpson, Van Santen, Steadman, Chiara & Simpson

[57] ABSTRACT

A method and apparatus for deflocculating a dry suspension of fibers wherein the fibers are introduced into a housing in suspension in air, and are allowed to commence settling by free fall through the housing. An impeller is positioned below the inlet and is in the path of the falling suspension, the impeller being rotated in such a manner that it provides air currents in opposition to the settling tendencies of the suspension. A foraminous forming means is located below the impeller, and cooperates with suction means acting thereon to form a sheet of fibers from the fibers which ultimately settle onto the foraminous forming means. In a particularly preferred embodiment of the present invention, there is included a mechanical vibrating means which is positioned below the impeller and is arranged to apply small amplitude sonic waves at the suspension passing to the forming means thereby additionally enhancing the deflocculation of the fibers in suspension.

6 Claims, 4 Drawing Figures vibrating means conveniently takes the form of a plurality of spaced taut wires and relatively flexible striker means for vibrating the wires. The combination of the hindered settling and the exposure to the sonic waves substantially deflocculates or breaks up the flocs or clumps of adhering fibers so that they are received as a uniform suspension on the forming means.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
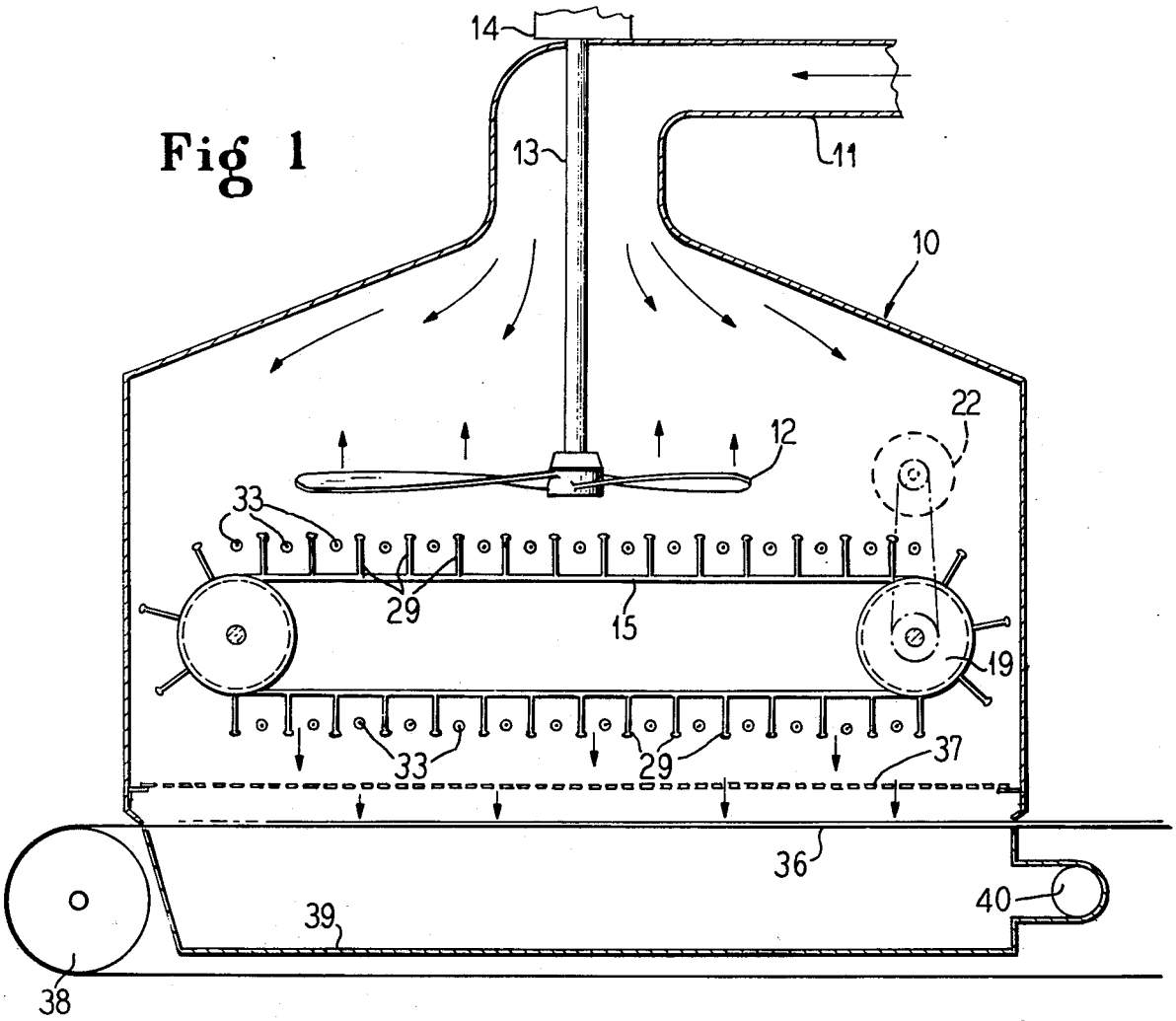
FIG. 1 is a view partly in elevation and partly in cross-section illustrating somewhat schematically an improved deflocculating device embodying the improvements of the present invention.

In FIG. 1, reference numeral 10 indicates generally a housing into which a duct 11 feeds a suspension of dry fibers and fiber flocs in air. The suspension is injected with sufficient pressure so that the fibrous materials are distributed as uniformly as possible across the cross-sectional area of the housing 10. As the fibers and the fiber flocs commence free settling within the housing 10, they are acted upon by air streams generated by an impeller which may take the form of a three bladed propeller 12. The propeller 12 is mounted on a drive shaft 13 which is driven by a motor 14 located outside the housing 10. The rotation of the propeller 12 causes air currents to be produced which hinder or inhibit the settling of the particles in the dispersion but the force of the air streams produced by the propeller 12 is insufficient to reverse the direction of the settling fibers or cause them to assume an equilibrium condition. The air currents generated by the propeller 12 significantly contribute to deflocculation of any flocs present in the suspension.

Figure 2:
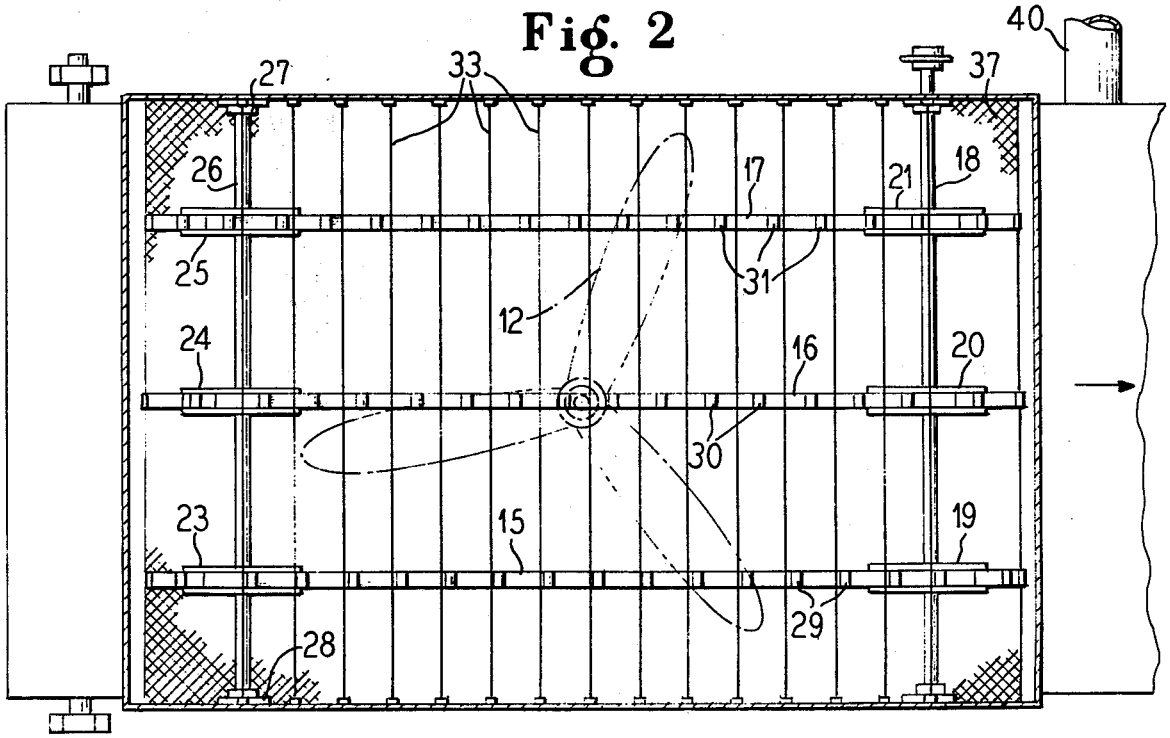
FIG. 2 is a cross-sectional view taken substantially along the line II—II of FIG. 1.

A further deflocculating effect is provided by means of mechanical vibration which increases the turbulence in the fiber suspension. Such mechanical vibrating means may take the form of a plurality of conveyors 15, 16 and 17 in spaced relationship as shown in FIG. 2. The conveyors 15 through 17 are driven in common by means of a drive shaft 18 to which their respective drive wheels 19, 20 and 21 are keyed or otherwise drivingly connected. The drive shaft in turn is driven by means of a motor 22 (FIG. 1). At their opposite ends, the conveyor belts 15, 16 and 17 are received about idler wheels 23, 24 and 25, respectively, and which are supported on a shaft 26 mounted for rotation between a pair of spaced bearings 27 and 28.

Each of the conveyor belts 15 through 17 carries a plurality of equally spaced flexible fingers or striker arms. The striker arms on conveyor 15 are identified at reference numeral 29 while those on conveyor belts 16 and 17 are identified at reference numerals 30 and 31, respectively. These striker arms are arranged to impact the vibrate a plurality of horizontally strung spaced wires 33. The wires 33 can be composed of piano wire or the like and are suitably taut so that impacting means of the strikers causes the production of compressional and rarefactional waves, usually a low audible frequencies. Resulting vibration in the housing enhances the deflocculation effect within the housing 10. Different types of suspensions have different optimum vibrational frequencies. To adjust for the different characteristics of various suspensions, it is possible to tighten or loosen the wires 33 accordingly.

As best illustrated in FIG. 2, the striker means 29, 30 and 31 are displaced from each other in a predetermined amount so that each wire 33 is excessively impacted by one of the three sets of striker means. For example, if the conveyor is moving in a clockwise direction as seen in FIG. 1, each wire 33 will first be impacted by a striker 31 on the belt 17, then by a striker 30 on the belt 16, and finally by a striker 29 on the belt 15.

The fibers settle in the spaces between the wires 33 and then pass onto a foraminous forming means which may take the form of a wire screen 36. Before doing so, however, the fibers pass through a filtering screen 37 which is of sufficiently coarse mesh to trap only clumps or flocs which have not been deflocculated while passing the individual fibers therethrough. The use of the screen 37 is optional and may not be necessary in all cases.

The forming wire 36 is trained around a roll 38 and may be of the type conventionally used for laying down paper webs. The foraminous surface is employed in conjunction with a suction box 39 which assists in laying down the random, non-woven web onto the surface of the forming wire 36. Greater or lesser degrees of suction can be employed, depending upon the thickness of the web sought to be deposited. The suction box 39 is supplied with a reduced pressure by means of a vacuum line 40.

Figure 3:
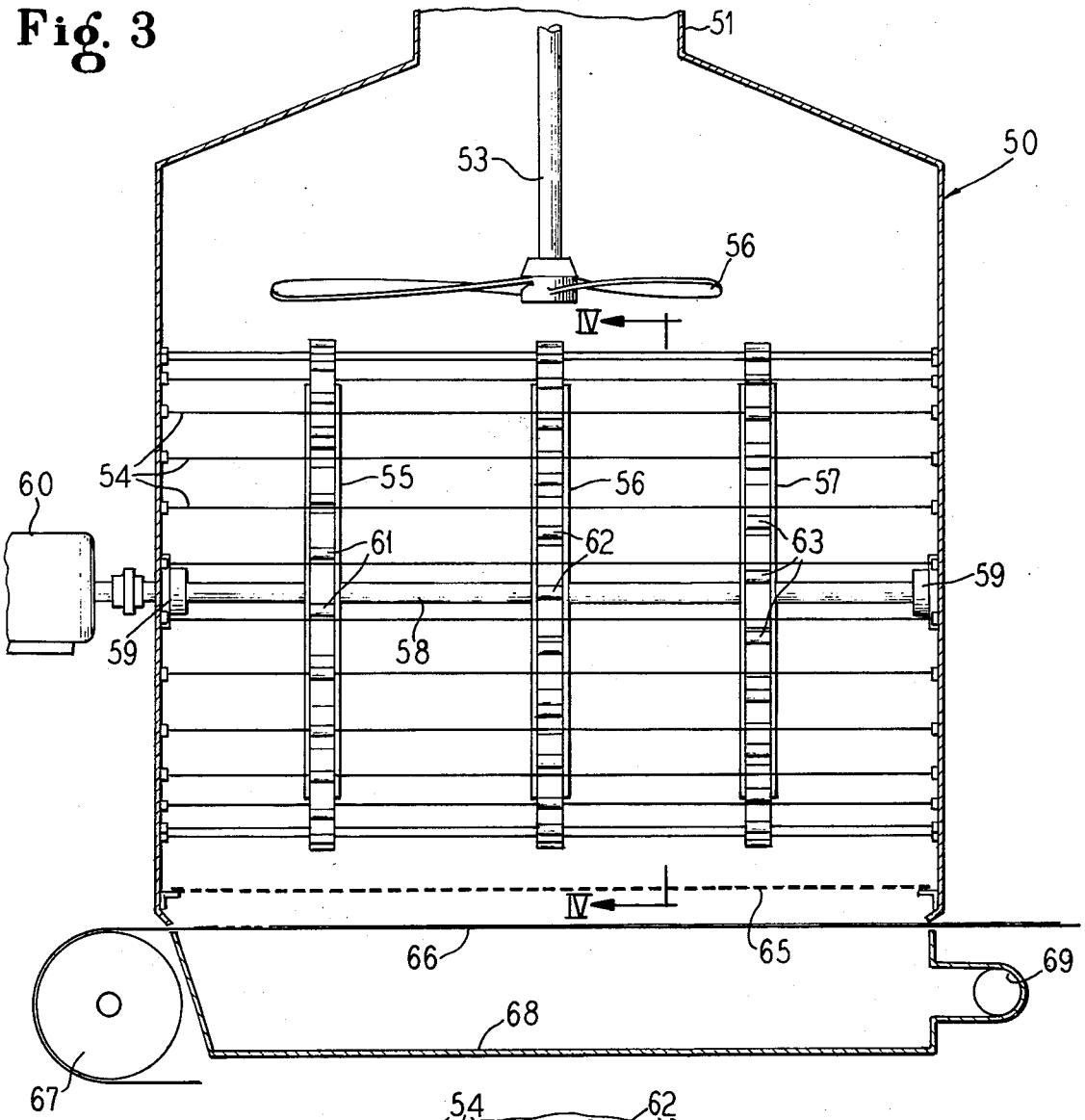
FIG. 3 is a view partly in cross-section and partly in elevation of another form of the invention.
Figure 4:
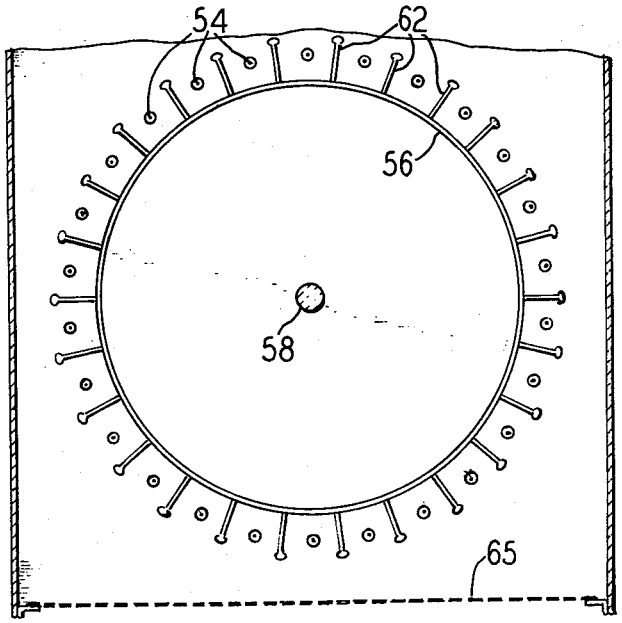
FIG. 4 is a cross-sectional view taken substantially along the line IV—IV of FIG. 3.

In another form of the invention, that illustrated in FIGS. 3 and 4, there is provided a housing 50 having an inlet end 51 through which the airborne dispersion of fibers is received. The free settling fibers are acted upon by air currents provided by a three bladed propeller 52 mounted for rotation by means of a shaft 53. In this form of the invention, a plurality of wires 54 consisting of piano wire or the like are tautly suspended between the walls of the housing in a circular pattern as illustrated in FIG. 4. A plurality of disks 55, 56 and 57 is supported for rotation on a drive shaft 58 which is received between spaced bearings 59 and is driven by a motor 60. Each of the disks carried flexible striker means such as fingers 61 located on disk 55, fingers 62 located on disk 56 and fingers 63 located on disk 57. These sets of fingers are arranged to sequentially strike the taut wires 54 as the disks are rotated and produce the sonic vibrations which assist in deflocculating the dispersion.

An optional screen 65 may be provided below the disks 55 to 57, inclusive, to separate out any coarse lumps which still remain. The fibers are settled onto a moving foraminous surface such as a forming wire 66 which is trained around a roll 67 and is acted upon by means of a reduced pressure appearing in a suction box 68 fed by a suction line 69.

The embodiment shown in FIGS. 3 and 4 operates in the same manner as the embodiment shown in FIG. 1 and 2. That is, the dispersion of fibers and floc is inhibited in its settling by means of air currents set up by the

APPARATUS FOR DEFLOCCULATING FIBROUS WAD AND UNIFORMLY DISTRIBUTING THE DISINTEGRATED FIBROUS MATERIAL ON A DRY FIBER LAYER FORMING SURFACE

BACKGROUND OF THE INVENTION

1. Field of the Invention

This invention is in the field of mechanical deflocculation of fibrous suspensions by means of controlled gravity settling coupled with sonic vibrations which operate to break up fiber flocs and permit the uniform deposition of a dry fiber layer on a suitable sheet forming means.

2. Description of the Prior Art

In any dry forming process for paper making, one of the most difficult tasks is that of providing a uniform fiber layer on a moving screen or forming fabric. Much of the difficulty comes from the fact that flocs or lumps of fiber tend to be deposited on the screen and non-uniform fiber distribution results.

We are familiar with a few prior U.S. patents which deal with similar problems but propose considerably different solutions. Pearson U.S. Pat. No. 3,126,584 deals with a machine for converting tows of filaments into a fibrous web and utilizes three sets of blades which act upon a tow successively, the first conditioning the tow for breakage, the succeeding sets of blades breaking the tow into fibers.

Langdon U.S. Pat. No. 3,395,426 deals with a machine for forming random fiber webs wherein the fibers are delivered by an air stream between two endless foraminous belts which travel around suction boxes. The belts are disposed with confronting reaches which converge toward one another in the direction of their travel so that they compact the fibers and form them into a mat as the fibers are pulled in between the belts by suction. The mat is delivered between two opening rolls which rotate in opposite directions and at different speeds. An air stream is used to doff the fibers from the rolls and deliver them onto a foraminous condenser by suction so that they are formed into a random fiber web.

Craig U.S. Pat. No. 3,408,697 describes an apparatus for forming a fiber mat wherein random length fibers are deposited on a continuously moving belt and are propelled by air down an inclined diverging chute and discharged into another air stream which directs the fibers in the opposite direction downwardly in a scattered array on the moving belt. The fibers are held on the belt by means of suction applied from below the porous belt.

Langdon U.S. Pat. No. 3,512,218 is similar to the aforementioned Langdon patent in that it provides a machine in which fibers or tufts of fibers are fed to rotating condensers on which the fibers are laid down by suction and the mats of fibers thus produced are doffed by doffing rolls. The mats are fed over feed plates by means of feed rolls to two rotating lickerins which comb the fibers from the mats. The fibers are doffed from the lickerins by centrifugal force and by an air stream flowing through a balancing chamber disposed centrally between the two condensers. The stream is then split into two parts so that it flows past the two lickerins. The two air streams then deliver the fibers doffed from the lickerins into an endless condenser belt on which the fibers are laid down in random fashion.

Radmussen U.S. Pat. No. 3,581,706 describes an apparatus for uniformly distributing a disintegrated material on a forming surface utilizing a cylindrical housing having a perforated plane surfaced bottom wall, an inlet opening for a stream of air containing suspended fibers, and a stirrer having impellers rotating a short distance above the perforated bottom wall. Any lumps or flocs are eliminated by providing a narrow slit in the side wall of the housing close to the screen, together with an air nozzle. The fibrous lumps which exist on the screen will eventually pass the slit where they are exposed to the influence of the air current from the air nozzle and are blown out of the housing.

Lipscomb et al. U.S. Pat. No. 3,736,211 describes an apparatus for improving dispersal and deposition of continuous filaments on a continuously moving surface utilizing a non-moving two-planar deflector which is positioned near the exit of an aspirator to provide greater openness and greater random laydown of the filaments.

Lipscomb et al. U.S. Pat. No. 3,738,894 describes another apparatus for depositing non-woven filaments utilizing a foraminal splaying device having two opposite surfaces with holes extending to at least one of the surfaces. A compressed gas is discharged through the holes in substantially parallel columns to penetrate a filament bundle which passes between the two opposing surfaces. The two opposing surfaces of the splaying device have continuous surfaces of curvature which surfaces exhibit a converging to diverging pattern as the opposing surfaces extend from the exit of the aspirator. The foraminous splaying device is positioned near the exit of an aspirator so as to spread the filaments in substantially all directions and thereby provide a random laydown of the filaments.

Finally, Helgesson U.S. Pat. No. 3,792,943 describes a machine for distributing dry fibers wherein the fibers are suspended in a rising stream of air which is deflected into a distribution chamber having a bottom formed by a gas permeable screen advanced over a suction box. A second stream of air is added to control the inflow of suspended fibers into the distribution chamber and to cause the fibers to follow a predetermined trajectory through the chamber. The pattern of fiber deposition on the moving screen is thus further controlled by admitting additional air from above through an adjustable opening in the enclosure of the distribution chamber.

SUMMARY OF THE INVENTION

The present invention provides an improved method and apparatus for deflocculating a dry suspension of fibers. The apparatus includes a housing, means for introducing the suspension of fibers vertically into the housing for free fall therethrough, and an impeller positioned below the inlet means and in the path of the falling suspension. Drive means are provided for rotating the impeller in a manner such that it provides air currents in opposition to the settling tendencies of the suspension. A foraminous forming means is located below the impeller means, and suction means act on the foraminous forming means to form a sheet of fibers from the fibers which are deposited ultimately from the hindered settling.

In the preferred form of the invention, a mechanical vibrating means is positioned below the impeller and is arranged to apply small amlitude compressional and rarefactional waves at sonic frequencies at the suspension passing to the forming means. The mechanical propeller 52. The slowly settling particles pass between the wires 54 where they are subjected to additional vibrational forces from the impacted wires. Finally, the fibers settle out on the moving foraminous surface 66 which, in conjunction with the suction provided in the suction box 68 serves to deposit a relatively uniform random fiber web on the forming surface.

It will be evident that various modifications can be made to the described embodiments without departing from the scope of the present invention.

We claim as our invention:

1. An apparatus for deflocculating a dry suspension of fibers which comprises:

a housing, inlet means for introducing said suspension of fibers vertically into said housing for free fall therethrough, an impeller positioned below said inlet means and in the path of the falling suspension of fibers, drive means for rotating said impeller in a manner such that it provides vertically upward directed air currents in opposition to the settling tendencies of said suspension of fibers, a foraminous forming means below said impeller means, and suction means acting on said foraminous forming means to form a sheet of fibers from the fibers settling onto said forming means.

2. An apparatus according to claim 1 which includes:

a mechanical vibrating means positioned below said impeller means and arranged to apply small amplitude compressional and rarefactional waves at the suspension of fibers passing to said forming means.

3. An apparatus according to claim 2 in which said mechanical vibrating means includes:

a plurality of spaced taut wires, and striker means for vibrating said wires.

4. An apparatus according to claim 3 in which said wires are stationary, and a conveyor means is arranged for progressively moving said striker means into impacting relationship with said wires.

5. An apparatus according to claim 1 which includes:

a screen between said impeller and said foraminous forming means for filtering large particles from the suspension of fibers reaching said foraminous forming means.

6. An apparatus for deflocculating a dry suspension of fibers which comprises:

a housing, inlet means in said housing for introducing said suspension of fibers into said housing for settling therethrough, an impeller positioned in the settling path of said suspension of fibers, means for rotating said impeller to direct upwardly directed air currents at said suspension of fibers to thereby inhibit the settling rate of said fibers and break up fiber flocs, a plurality of taut wires extending in horizontally spaced relationship within said housing, a conveyor means, striker means carried by said conveyor means and arranged to successively impact said wires causing sonic waves to be produced which assist in deflocculating said suspension of fibers, foraminous forming means receiving the settled fibers, and suction means cooperating with said forming means to form a sheet from the settled fibers.

* * * * *